US008632299B2

(12) United States Patent
Eleftheriou et al.

(10) Patent No.: US 8,632,299 B2
(45) Date of Patent: Jan. 21, 2014

(54) ENGINE CASE WITH WASH SYSTEM

(75) Inventors: Andreas Eleftheriou, Woodbridge (CA); David Menheere, Georgetown (CA); Richard Ivakitch, Toronto (CA); Enzo Macchia, Kleinburg (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 577 days.

(21) Appl. No.: 12/956,405

(22) Filed: Nov. 30, 2010

(65) Prior Publication Data

US 2012/0134777 A1 May 31, 2012

(51) Int. Cl.
*F01D 25/26* (2006.01)

(52) U.S. Cl.
USPC ..... 415/116; 415/108; 415/144

(58) Field of Classification Search
USPC ..... 415/108, 110, 116, 121.2, 169.2, 169.3, 415/169.4, 213.1, 220
See application file for complete search history.

(56) References Cited

U.S. PATENT DOCUMENTS

| | | | | |
|---|---|---|---|---|
| 2,549,819 | A | 4/1951 | Kane | |
| 3,623,668 | A | 11/1971 | Freid | |
| 4,046,155 | A | 9/1977 | Mansson | |
| 5,011,540 | A | 4/1991 | McDermott | |
| 5,193,976 | A | 3/1993 | Kolev et al. | |
| 5,944,483 | A | 8/1999 | Beck et al. | |
| 6,491,048 | B1 | 12/2002 | Foster | |
| 6,553,768 | B1 | 4/2003 | Trewin et al. | |
| 6,659,715 | B2 | 12/2003 | Kuesters et al. | |
| 7,114,910 | B2 | 10/2006 | Stalder | |
| 7,185,663 | B2 | 3/2007 | Koch et al. | |
| 7,520,137 | B2 | 4/2009 | Hoffmann et al. | |
| 7,571,735 | B2 | 8/2009 | Wagner | |
| 7,648,335 | B2 | 1/2010 | Stalder | |
| 7,670,440 | B2 * | 3/2010 | Asplund et al. | 134/169 A |
| 7,797,922 | B2 * | 9/2010 | Eleftheriou et al. | 60/226.1 |
| 2006/0048796 | A1 | 3/2006 | Asplund et al. | |

* cited by examiner

*Primary Examiner* — Ninh H Nguyen

(74) *Attorney, Agent, or Firm* — Norton Rose Fulbright Canada LLP

(57) ABSTRACT

A gas turbine engine includes a structure defining a circumferential passage in fluid communication with an internal passage in at least one strut radially extending into the engine, circumferential passage also in fluid communication with a plurality or nozzles or jets to provide a wash manifold integrated with the engine casing structure. One or more nozzles are provided in the manifold for directing a washing fluid injected into the duct.

12 Claims, 4 Drawing Sheets

ENGINE CASE WITH WASH SYSTEM

TECHNICAL FIELD

The described subject matter relates generally to gas turbine engines and more particularly, to an improved engine case with an wash system.

BACKGROUND OF THE ART

Deposits and dirt on the compressor and other blades in a gas turbine engine impair the aerodynamic condition and dynamics of the engine, thereby affecting efficiency. At various maintenance intervals, it is desirable to wash the engine in order to reduce build-up on the blades. Accessing some blade stages can be difficult from the engine inlet or exhaust, thereby often requiring washing either by removing other engine equipment, such as bleed valves, or by using a dedicated borescope or wash ports to provide access to the engine interior. The conventional approaches are time consuming and/or difficult to provide access for cleaning purposes, which results in poor cleaning.

Accordingly, there is a need to provide an improved wash system for a gas turbine engine.

SUMMARY

In one aspect, the described subject matter provides a gas turbine engine having a compressor, the engine comprising an annular outer case surrounding at least a section of the gas turbine engine; an annular core case concentrically positioned within the outer case and radially outwardly of the compressor, the core case having an annular leading edge providing a splitter to divide an air flow duct from an inlet of the engine into a bypass air flow duct and a core air flow duct, the splitter defining a circumferential passage therein, the passage communicating with a plurality of exit jets configured to direct a washing fluid from the passage into the core air flow duct to blades of the compressor; and a plurality of circumferentially spaced struts radially extending from the outer case to the core case, the struts including at least one having an internal passage therein in fluid communication with the circumferential passage defined in the splitter, the at least one strut internal passage communicating also with an inlet configured to receive a flow of washing fluid from a source external to the engine.

In another aspect, the described subject matter provides a gas turbine engine comprising an annular case surrounding at least one stage of a compressor rotor, the annular case including a compressor shroud defining a flow duct for directing air to axially pass through the at least one stage of the compressor rotor, the annular case having a hollow structure defining a circumferential passage; and a plurality of hollow struts extending radially and inwardly from the annular case to a stationary support structure, and being circumferentially spaced apart one from another and positioned in the flow duct upstream of the at least one stage of the compressor rotor, the hollow struts and the circumferential passage in the annular case being in fluid communication to thereby define an integrated compressor wash manifold having at least one nozzle for injecting a washing fluid into the flow duct.

In a further aspect, the described subject matter provides a gas turbine engine comprising an annular outer case surrounding at least a section of the gas turbine engine; an annular core case concentrically positioned within the outer case and radially outwardly of a rotating blade set of the engine, the core case having a circumferential wall defining an hollow annular passage extending internally about the case, the passage communicating with a plurality of exit jets configured to direct a washing fluid from the internal passage into the core air flow duct to the blade set; and a plurality of circumferentially spaced struts radially extending from the outer case to the core case, the struts including at least one having an internal passage therein in fluid communication with the hollow annular passage, the at least one strut internal passage communicating also with an inlet configured to receive a flow of washing fluid from a source external to the engine Further details of these and other aspects of the described subject matter will be apparent from the detailed description and figures included below.

DESCRIPTION OF THE DRAWINGS

Reference is now made to the accompanying figures depicting aspects of the described subject matter, in which.

DETAILED DESCRIPTION

Figure 1:
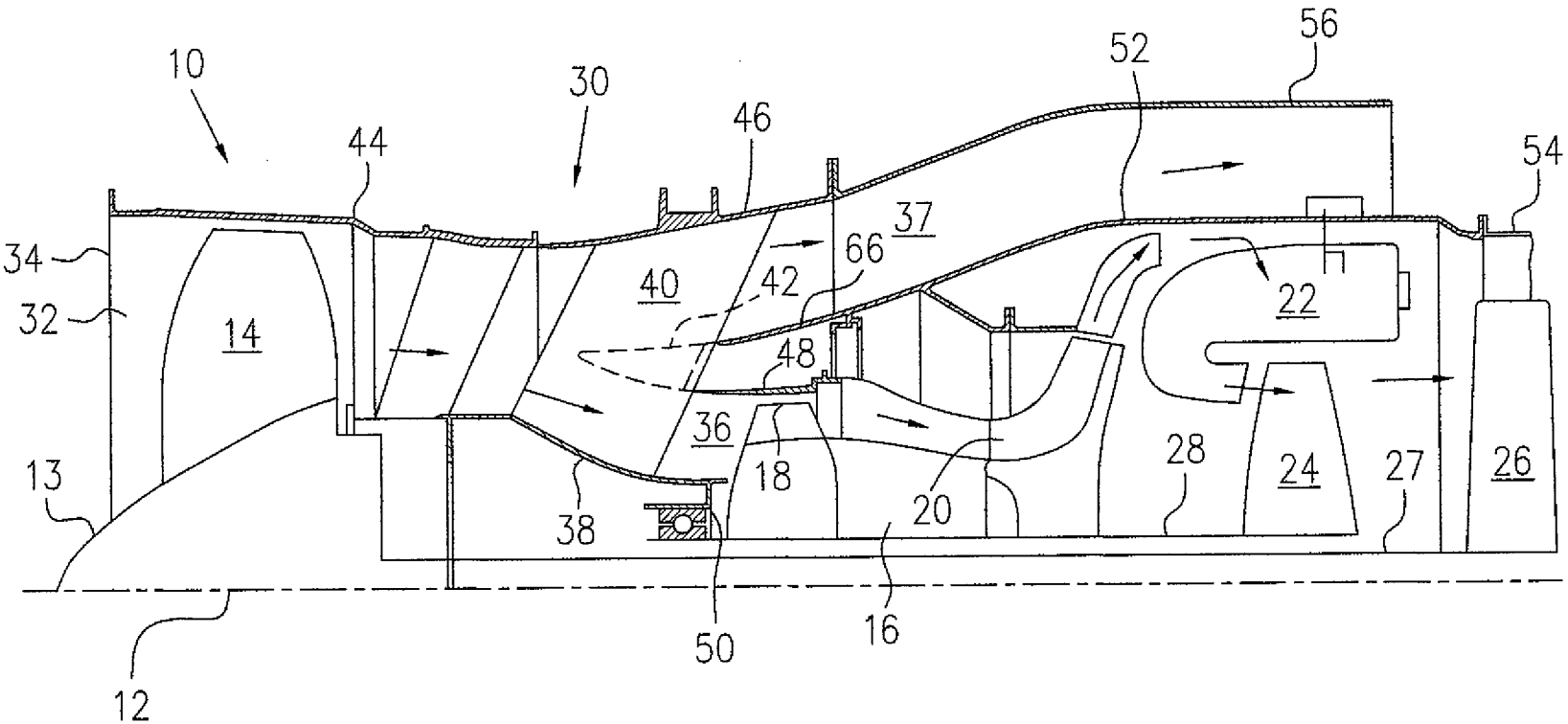
FIG. 1 is a schematic cross-sectional view of a turbofan gas turbine engine as an application of the described subject matter.

Referring to the drawings, beginning with FIG. 1, a turbofan gas turbine engine 10 which is taken as an exemplary application of the described subject matter, includes in serial flow communication about a longitudinal central axis 12, a fan assembly 13 having a plurality of circumferentially spaced fan blades 14, a compressor section 16 having a plurality of circumferentially spaced high pressure compressor blades 18 and 20, a combustor 22, a high pressure turbine 24 and a low pressure turbine 26. The low pressure turbine 26 is connected to the fan assembly 13 by a low pressure shaft 27, and the high pressure turbine 24 is connected to the compressor section 16 by a high pressure shaft 28.

A generally tubular casing assembly 30 envelopes the engine 10 and thereby defines a main flow path 32 which extends from an inlet 34 of the engine 10 and is divided into a core flow duct 36, extending to an exhaust outlet (not shown), and a bypass flow duct 37. This will be further described below.

The casing assembly 30 may include a generally tubular fan case 44, which houses the fan rotor assembly 13, a generally tubular intermediate case 46 downstream of the fan case 44 and a gas generator case 52 downstream of the intermediate case 46. The intermediate case 46 further includes a compressor shroud 48 which encircles the blade tips of the compressor section 16, and an inner hub 38 with a bearing seat 50 for mounting the high pressure shaft bearing (as shown) thereto. The gas generator case 52, which is also generally tubular in shape, houses the combustor 22 and perhaps the high pressure turbine 24 or a section thereof. A generally tubular exhaust case 54 may also be modularly provided and mounted to an aft end of the gas generator case 52 for housing the low pressure turbine 26 and for supporting an exhaust mixer assembly (not shown).

The engine 10 may further include a generally tubular bypass duct case 56, for example, mounted to the intermediate case 46 of the casing assembly 30. The tubular bypass case 56 generally surrounds the gas generator case 52 and is radially spaced apart therefrom, thereby defining a downstream section of the bypass flow duct 37 therebetween. A similar casing assembly for a gas turbine engine is described in U.S. Pat. No. 7,372,467, issued on May 13, 2008 and assigned to the same assignee of this application, which is incorporated by reference herein.

Figure 2:
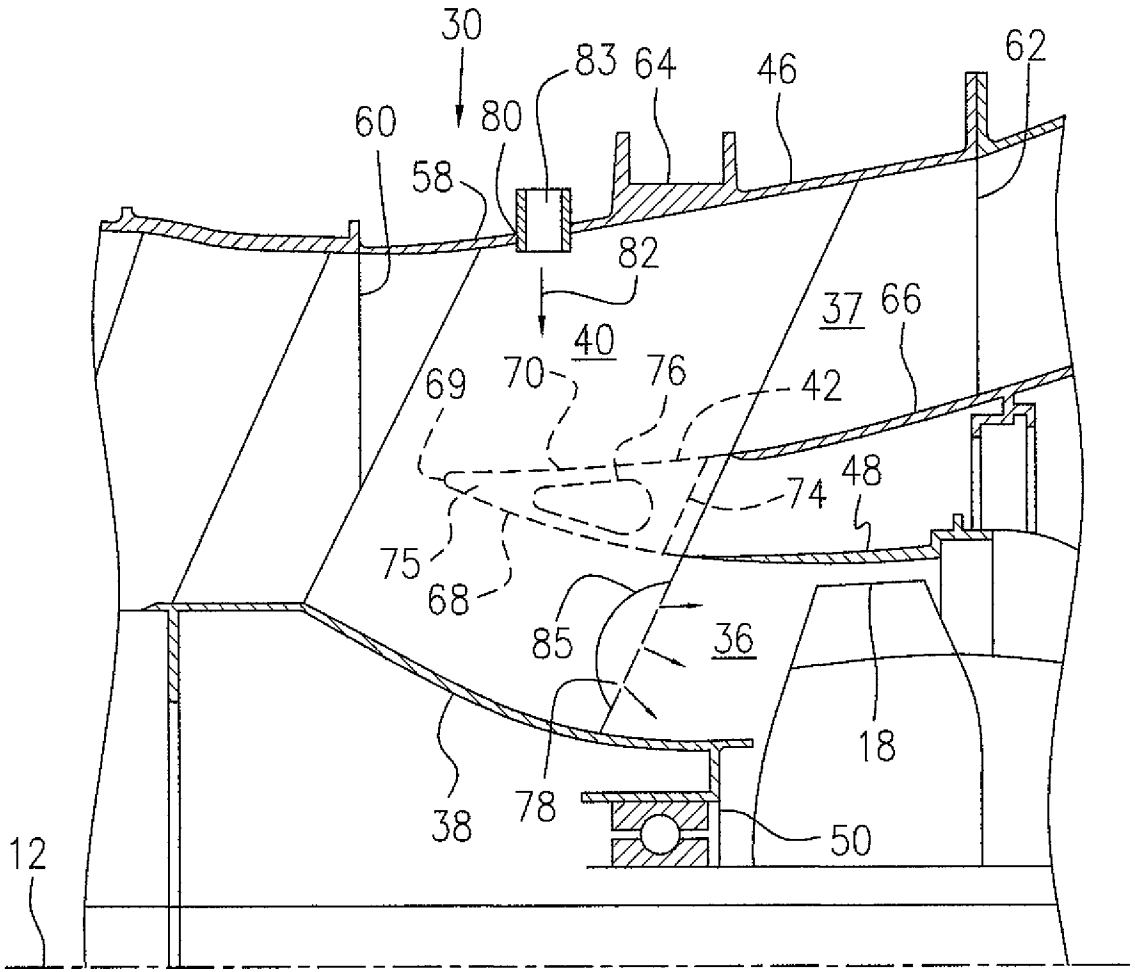
FIG. 2 is a partial schematic cross-sectional view of the engine of FIG. 1, showing a compressor wash manifold integrated with an engine case according to one embodiment.
Figure 5:
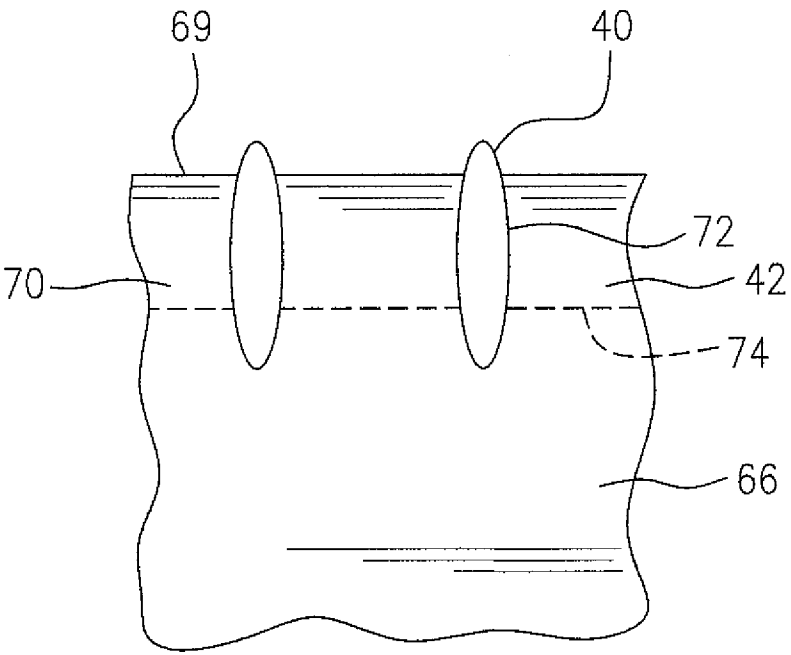
FIG. 5 is a partial schematic top plan view of the annular core case of the intermediate case of FIG. 2 with the radially extending hollow struts (only two are shown) joined together, showing the joint structure thereof.

Referring to FIGS. 2 and 5, the intermediate case 46, according to one embodiment, may have an annular outer ring 58 having a forward end 60 and a rearward end 62. An engine mount 64 may be provided on the external surface of the outer ring 58. The intermediate case 46 of the casing assembly 30 may also include an annular core case 66 which is radially positioned within the outer ring 58 and includes an annular splitter 42 forming a leading edge of the core case 66 to divide an air flow from the inlet 34 of the engine into a bypass air flow passing through the annular bypass duct 37 and a core air flow to enter an annular core flow duct 36 within the core case 66, as illustrated in FIG. 1. The arrows shown in FIG. 1 represent the respective air flows. The splitter 42 may have an annular inner wall 68 and an annular outer wall 70 extending axially and downstream relative to the air flow through the engine 10, divergent from an annular leading edge tip 69 of the splitter 42. The inner wall 68 extends to and is connected with the compressor shroud 48 which surrounds at least one rotor stage of the compressor section 16, such as one stage of the high pressure compressor, shown as compressor blades 18.

A plurality of circumferentially spaced apart hollow casing struts 40 radially inwardly extend from the outer ring 58 through the bypass flow duct 37 and the core flow duct 36 to the annular inner hub 38, intersecting and joining the annular splitter 42. An inner end section of the hollow casing struts 40 is therefore positioned within the core flow duct 36 upstream of the high pressure compressor blades 18.

A plurality of circumferentially spaced apart slots 72 extend generally from the annular tip 69 axially into the splitter 42, for receiving the respective hollow casing struts 40. The respective hollow casing struts 40 are connected to the annular core case 66 by for example, welding applied along the edges of slots 72 in the splitter 42.

The hollow splitter 42 according to this embodiment, may include a plurality of stiffeners 74 positioned within the hollow splitter 42, each stiffener 74 radially extending between the inner and outer walls 68 and 70, and being affixed thereto, and circumferentially extending between two adjacent hollow casing struts 40, and also being affixed thereto. Therefore, each stiffener 74 and the inner and outer walls 68 and 70 in combination form a triangular enclosed space between two adjacent hollow casing struts 40. An opening 76 is provided in each side wall (not indicated) of the respective hollow casing struts 40 located in an area within the boundaries defined by the inner and outer walls 68, 70 together with the stiffener 74, such that respective triangular enclosed spaces 75 are in fluid communication with the respective hollow casing struts 40 through the respective openings 76, thereby defining an annular or circumferential fluid passage (not indicated). This annular or circumferential fluid passage in combination with the inner end section of the respective hollow casing struts 40 radially extending through the core flow duct 36 between splitter 42 and the inner hub 38, therefore form a compressor wash manifold (not indicated) integrated with the intermediate case 46, which is provided with one or more nozzles (not indicated) for injecting washing fluid into the core flow duct 36 of the engine.

For example, one or more nozzle orifices 78 (three orifices are shown in FIG. 2) may be provided in one or more of the hollow casing struts 40, at a trailing edge thereof within the core flow duct 36. An inlet opening 80 may be provided in the annular outer ring 58 in fluid communication with one of the hollow casing struts 40, for receiving a washing fluid flow 82 during a compressor washing operation. The washing fluid flow 82 flows radially inwardly through the hollow casing strut 40 and is circumferentially distributed through the triangular enclosed spaces 75 within the hollow splitter 42 into the remaining hollow casing struts 40, and is then injected under pressure through the nozzle orifices 78 into the core flow duct 36.

A deflector 85 according to one embodiment may be positioned within one or more of the hollow casing struts 40, adjacent to the nozzle orifices 78. The deflector 85 is for example made of a plate bent in a curved or concave shape to be affixed at the top and bottom ends thereof to the hollow casing struts 40 so as to allow the washing fluid flow 82 in the hollow casing strut 40 to enter the deflector 85. The curved or concave shape of the deflector 85 provides direction guidance for the washing fluid injected from the orifices 78.

A quick-release fitting 83 may be removably attached to the opening 80 in the outer ring 58 for connection with a washing fluid supply hose (not shown) during a compressor wash operation. The quick-release fitting 83 may be removed and a cover plate (not shown) may be used to seal the inlet opening 80 when the compressor wash operation is completed.

Figure 4:
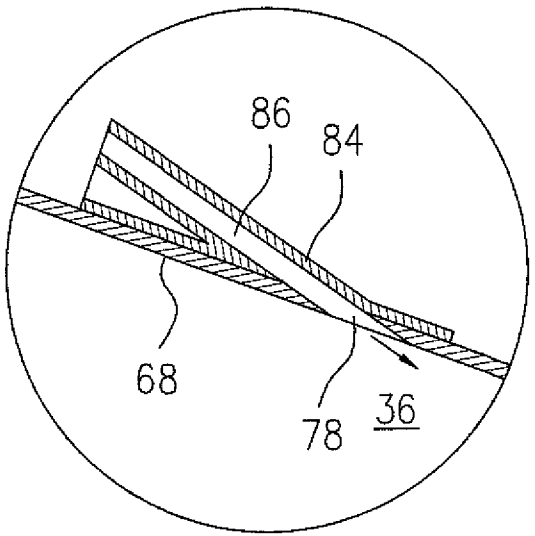
FIG. 4 is a cross-sectional view of an enlarged portion, in a circle of FIG. 4, showing a nozzle passage of the nozzle located within the hollow splitter.
Figure 3:
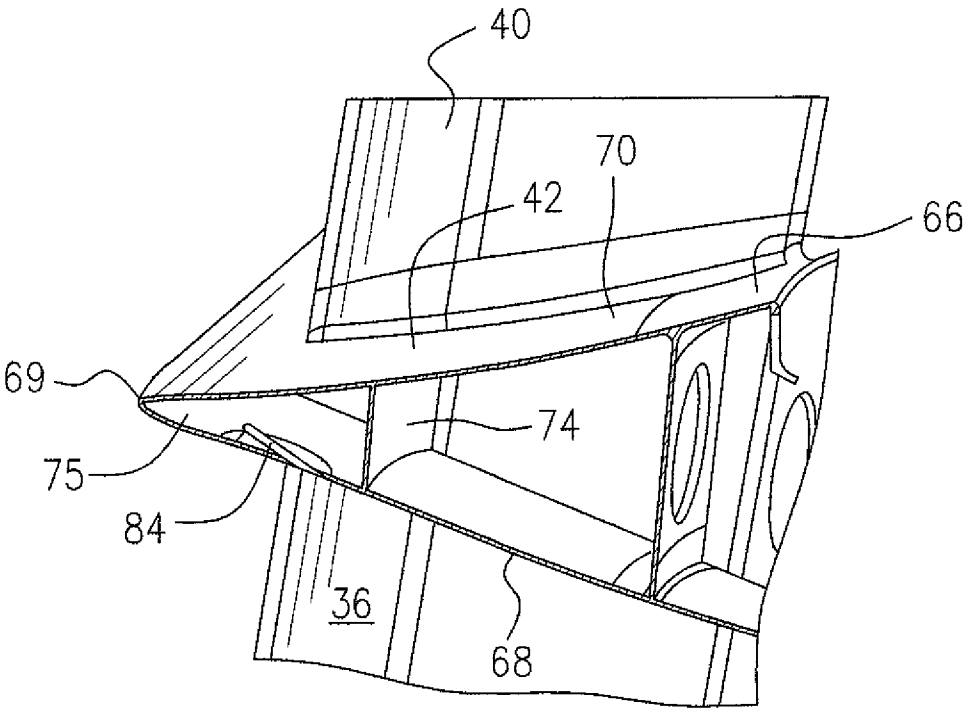
FIG. 3 is partial perspective view of the gas turbine engine of FIG. 1 with a portion of the engine cut away to show a nozzle located within a hollow splitter of the engine case according to another embodiment.
Figure 6:
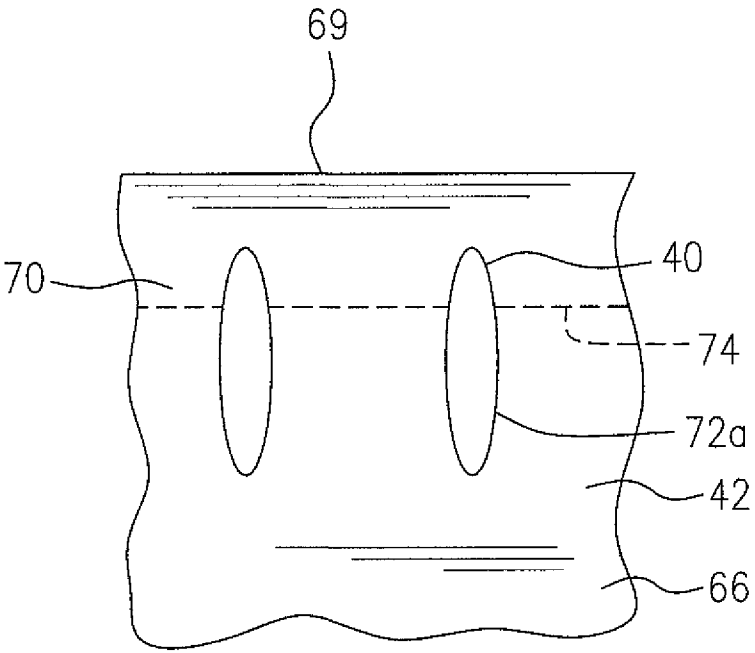
FIG. 6 is a partial schematic top plan view of the splitter 42 of FIG. 3, adjoining structure with radially extending hollow casing struts 40.

In FIGS. 3, 4 and 6 which show another embodiment, the hollow splitter 42 extends further forward, in contrast to that of FIG. 5, such that the annular leading edge tip 69 of the splitter 42, is positioned upstream of the leading edge (not indicated) of the respective hollow casing struts 40. The hollow casing struts 40 are received in respective slots 72*a* (see FIG. 6) defined in the hollow splitter 42 and are affixed thereto, for example by welding along the edge of the slots 72*a*. In this embodiment, the triangular enclosed space 75 within the boundaries defined by the inner and outer walls 68, 70 and the stiffener 74 (see FIG. 3) is not completely blocked in the circumferential direction and a portion of the space 75 near the leading edge tip 69 of the splitter 42 (which is located upstream of the leading edge of the respective hollow casing struts 40), extends circumferentially to form an annular fluid passage (not indicated). One or more nozzle orifice 78 (see FIG. 4) may be provided in the inner wall 68 of the hollow splitter 42 for injecting the washing fluid into the core flow duct 36. A nozzle body 84 may be attached to the inner surface of the inner wall 68 of the hollow splitter 42 and configured to define a nozzle passage only within the hollow splitter 42, and may be oriented in any desired direction for controlling the flow of washing fluid injected through the nozzle orifice 78 into the core flow duct 36.

When the nozzle orifices 78 are provided only in the inner wall 68 of the hollow splitter 42, the openings 76 in the side walls of the respective hollow casing struts 40 (see FIG. 2) may not be necessary in the embodiment shown in FIGS. 3 and 6, except in one hollow casing strut 40 which is in fluid communication with the inlet opening 80 in the outer ring 58 (also see FIG. 2) for receiving the washing fluid flow 82 from that hollow casing strut 40 into the annular passage defined by the hollow splitter 42. However, when the nozzle orifices 78 are desired in the respective hollow struts as shown in FIG. 2, the openings 76 defined in the side walls of the respective hollow casing struts 40, are needed to allow the washing fluid flow 82 in the hollow splitter 42 to enter the respective hollow casing struts 40.

The above description is meant to be exemplary only, and one skilled in the art will recognize that changes may be made to the embodiments described without departure from the scope of the described subject matter. For example, although a hollow splitter or an intermediate case of a turbofan gas turbine engine is described as an example embodiment, a casing structure associated with any bladed stage or other structure requiring periodic washing or other fluid maintenance treatment in any type of gas turbine engine may be provided following the spirit of the described subject matter. The described subject matter is not limited to the exemplary manner in which the wash or maintenance fluid is delivered to the engine components. Any suitable engine construction providing the described features may be employed. Therefore, the described subject matter is not limited to either the hollow splitter casing structure or a casing structure of a turbofan gas turbine engine. Still other modifications which fall within the spirit of the described subject matter will be apparent to those skilled in the art, in light of a review of this disclosure, and such modifications are intended to fall within the appended claims.

The invention claimed is:

1. A gas turbine engine having a compressor, the engine comprising:

an annular outer case surrounding at least a section of the gas turbine engine;

an annular core case concentrically positioned within the outer case and radially outwardly of the compressor, the core case having an annular leading edge providing a splitter to divide an air flow duct from an inlet of the engine into a bypass air flow duct and a core air flow duct, the splitter defining an annular passage therein, the passage communicating with the core air flow duct through a plurality of nozzle orifices configured on the splitter; and a plurality of circumferentially spaced struts radially extending from the outer case to the core case, the struts including at least one having an internal passage therein in fluid communication with the annular passage defined in the splitter, the at least one strut internal passage communicating also with an inlet configured on the outer case to receive a flow of washing fluid from a source external to the engine, and directing the flow of washing fluid through the annular passage and the nozzle orifices into the core air flow duct to blades of the compressor.

2. The engine as defined in claim 1 wherein the splitter is substantially hollow about its circumference.

3. The engine as defined in claim 1 further comprising an inner case located inwardly of the annular core case, a plurality of struts extending from the annular core case to the inner case, and at least one nozzle orifice located in a wall of hollow one of the struts, the at least one nozzle orifice positioned radially between the splitter and the inner case and communicating with the annular passage defined in the splitter through the hollow one of the struts to direct the flow of washing fluid into the core air flow duct.

4. The engine as defined in claim 3 wherein the hollow one of the struts comprises a deflector attached to an inside of the strut, the deflector positioned adjacent the at least one nozzle orifice for directing the flow of washing fluid to the at least one nozzle orifice.

5. The engine as defined in claim 4 wherein a plurality of nozzle orifices including the at least one nozzle orifice are defined in the wall of the hollow one of the struts, adjacent to the deflector.

6. A gas turbine engine comprising:

an annular case surrounding at least one stage of a compressor rotor, the annular case including a compressor shroud defining a flow duct for directing air to axially pass through the at least one stage of the compressor rotor, the annular case having a hollow structure defining an annular passage;

a plurality of hollow struts extending radially and inwardly from the annular case to a stationary support structure, and being circumferentially spaced apart one from another and positioned in the flow duct upstream of the at least one stage of the compressor rotor, the hollow struts and the annular passage in the annular case being in fluid communication to thereby define an integrated compressor wash manifold having at least one nozzle orifice on the annular case or on a wall of one of the hollow struts for injecting a flow of washing fluid into the flow duct; and an engine structure surrounding and supporting said annular case, the engine structure including an inlet passage accessible from outside the engine and communicating with the annular passage to receive a washing fluid supply for the integrated compressor wash manifold.

7. The engine as defined in claim 6 wherein the at least one nozzle orifice is one of a plurality of nozzle orifices located in the respective hollow struts.

8. The engine as defined in claim 6 wherein the at least one nozzle orifice is one of a plurality of circumferentially spaced nozzle orifices located in a wall of the annular passage of the annular case.

9. The engine as defined in claim 6 wherein the hollow structure of the annular case defining the annular passage, is located at a leading edge of the annular case.

10. The engine as defined in claim 6 wherein the engine structure comprises an outer case surrounding the annular case and a plurality of support struts radially extending between the annular case and the outer case, at least one of the support strut being hollow and defining said inlet passage in fluid communication with the wash manifold.

11. The engine as defined in claim 6 wherein the integrated compressor wash manifold comprises means located within the manifold for directing the flow of washing fluid injected through the at least one nozzle orifice.

12. A gas turbine engine comprising:

an annular outer case surrounding at least a section of the gas turbine engine;

an annular core case concentrically positioned within the outer case and radially outwardly of a rotating blade set of the engine, the core case having a circumferential wall in a hollow configuration defining an annular passage extending internally about the case, the annular passage communicating with the core case through a plurality of nozzle orifices configured on the circumferential wall or in a hollow support structure within the core case, the hollow support structure being connected to the circumferential wall; and a plurality of circumferentially spaced struts radially extending from the outer case to the core case, the struts including at least one having an internal passage therein in fluid communication with the annular passage, the at least one strut internal passage communicating also with an inlet configured on the outer case to receive a flow of washing fluid from a source external to the engine, and directing the flow of washing fluid through the annular passage and the nozzle orifices into the core case to the blade set.

* * * * *